US012509813B2

(12) United States Patent
Ewing

(10) Patent No.: US 12,509,813 B2
(45) Date of Patent: Dec. 30, 2025

(54) LAUNDRY APPLIANCE AND DAMPER ASSEMBLY THEREFOR

(71) Applicant: Haier US Appliance Solutions, Inc., Wilmington, DE (US)

(72) Inventor: Cody Ewing, Floyds Knobs, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 153 days.

(21) Appl. No.: 18/347,219

(22) Filed: Jul. 5, 2023

(65) Prior Publication Data

US 2025/0011995 A1 Jan. 9, 2025

(51) Int. Cl.

| | |
|---|---|
| ***D06F 37/24*** | (2006.01) |
| ***D06F 23/04*** | (2006.01) |
| ***D06F 37/22*** | (2006.01) |
| ***D06F 37/26*** | (2006.01) |

(52) U.S. Cl.

CPC ..... *D06F 37/24* (2013.01); *D06F 23/04* (2013.01); *D06F 37/22* (2013.01); *D06F 37/268* (2013.01)

(58) Field of Classification Search

CPC ..... D06F 23/04; D06F 37/20; D06F 37/22; D06F 37/24; D06F 37/268

See application file for complete search history.

(56) References Cited

U.S. PATENT DOCUMENTS

| | | | | |
|---|---|---|---|---|
| 5,115,950 | A | 5/1992 | Rohr | |
| 5,263,559 | A | 11/1993 | Mettner | |
| 5,528,913 | A | 6/1996 | Savkar | |
| 5,606,879 | A | 3/1997 | Froelicher et al. | |
| 5,839,614 | A | 11/1998 | Brown | |
| 6,009,730 | A | 1/2000 | Lee | |
| 8,813,527 | B2 | 8/2014 | Vincent | |
| 10,889,486 | B1 * | 1/2021 | Laible | B67D 3/0045 |
| 2008/0264744 | A1 | 10/2008 | Atwater et al. | |
| 2009/0031761 | A1 | 2/2009 | Kim et al. | |
| 2015/0336719 | A1 * | 11/2015 | Bradley | B65D 47/06 220/212 |
| 2015/0337478 | A1 * | 11/2015 | Davis | D06F 37/24 312/228 |

(Continued)

FOREIGN PATENT DOCUMENTS

| | | | |
|---|---|---|---|
| CN | 105177927 | A | 12/2015 |
| CN | 107420475 | A | 12/2017 |

(Continued)

*Primary Examiner* — Joseph L. Perrin
(74) *Attorney, Agent, or Firm* — Dority & Manning, P.A.

(57) ABSTRACT

A laundry appliance and damper assembly therefor are provided. The laundry appliance includes a cabinet defining an interior, a tub mounted within the interior of the cabinet, and a laundry basket rotatably mounted within the tub. The laundry basket defines a chamber for the receipt of laundry articles. A damper assembly couples the cabinet to the tub. The damper assembly includes a body forming an interior volume. A piston is coupled to a shaft extending through the interior volume. The piston extends to an inner surface of the body at the interior volume. A spring is positioned within the interior volume and is configured to generate a resistive force against the piston. The damper assembly includes a valve including a flexible wall forming a separable interface configured to allow air to flow into the interior volume as the spring extends.

16 Claims, 8 Drawing Sheets

(56) References Cited

U.S. PATENT DOCUMENTS

| | | | | |
|---|---|---|---|---|
| 2017/0227136 | A1* | 8/2017 | Workman | B60K 15/03519 |
| 2019/0000716 | A1* | 1/2019 | Fiere | A61J 1/1418 |
| 2019/0055687 | A1* | 2/2019 | Deshpande | D06F 37/20 |

FOREIGN PATENT DOCUMENTS

| | | | |
|---|---|---|---|
| JP | H05154282 | A | 6/1993 |
| KR | 20050086213 | A | 8/2005 |
| KR | 20060003192 | A | 1/2006 |
| WO | WO2015125075 | A1 | 8/2015 |

* cited by examiner

LAUNDRY APPLIANCE AND DAMPER ASSEMBLY THEREFOR

FIELD OF THE INVENTION

The present subject matter relates generally to laundry appliances, and more particularly to damper assemblies for laundry appliances.

BACKGROUND OF THE INVENTION

Laundry appliances, such as washing appliances, dryer appliances, or combination washer/dryer appliances include a drum and a basket at which laundry articles are positioned for wash or dry. The basket is configured to rotate within the drum, such as for performing a wash cycle (e.g., wash, rinse, spin, etc.) or a dry cycle.

Laundry appliances including air damper assemblies may provide a low cost component for a suspension of a drum at a laundry appliance. However, air dampers may lack performance at certain speed ranges, such as high speed. For instance, at low speed, air leakage across the air damper may be sufficient such that a damping value is in a desirable range. However, as piston speed increases at the air damper assembly, the air leakage is insufficient to prevent the damper assembly from acting as a gas spring, resulting in increased damping during the compression and extension strokes of the piston. High damping during the extension stroke may result in the damper assembly becoming unseated from the tub. Such repeated compression and extension motion may cause impact of the top of the damper assembly to start the compression stroke, and such impact may result in undesired noise and deterioration.

Friction dampers may eliminate the air damping component by including foam. However, foam dampers are generally higher cost than air dampers and may experience decreased performance as the temperature of the foam increases. For instance, damping force is significantly reduced or eliminated as the foam heats up.

Still other dampers may include an air chamber including a controlled pressure system, such as for custom damping. However, the increased costs associated with controlled systems may cause such dampers to be prohibitively expensive to be incorporated into a laundry appliance.

As such, a laundry appliance, and a damper assembly therefor, addressing one or more of the aforementioned issues would be advantageous and beneficial. Additionally, a laundry appliance, and a damper assembly, providing improved damping at low speed and high speed, and at low cost and robust performance, would be advantageous and beneficial.

BRIEF DESCRIPTION OF THE INVENTION

Aspects and advantages of the invention will be set forth in part in the following description, or may be obvious from the description, or may be learned through practice of the invention.

An aspect of the present disclosure is directed to a laundry appliance including a cabinet defining an interior, a tub mounted within the interior of the cabinet, and a laundry basket rotatably mounted within the tub. The laundry basket defines a chamber for the receipt of laundry articles. A damper assembly couples the cabinet to the tub. The damper assembly includes a body forming an interior volume. A piston is coupled to a shaft extending through the interior volume. The piston extends to an inner surface of the body at the interior volume. A spring is positioned within the interior volume and is configured to generate a resistive force against the piston. The damper assembly includes a valve including a flexible wall forming a separable interface configured to allow air to flow into the interior volume as the spring extends.

Another aspect of the present disclosure is directed to a damper assembly for a laundry appliance. The damper assembly includes a body forming an interior volume within the body and an exterior volume outside of the body. The damper assembly includes a shaft extending through the interior volume. A piston is coupled to the shaft, the piston extending to an inner surface of the body at the interior volume. A spring is positioned within the interior volume and configured to generate a resistive force against the piston. A valve includes a flexible wall forming a separable interface configured to allow air to flow into the interior volume as the spring extends.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
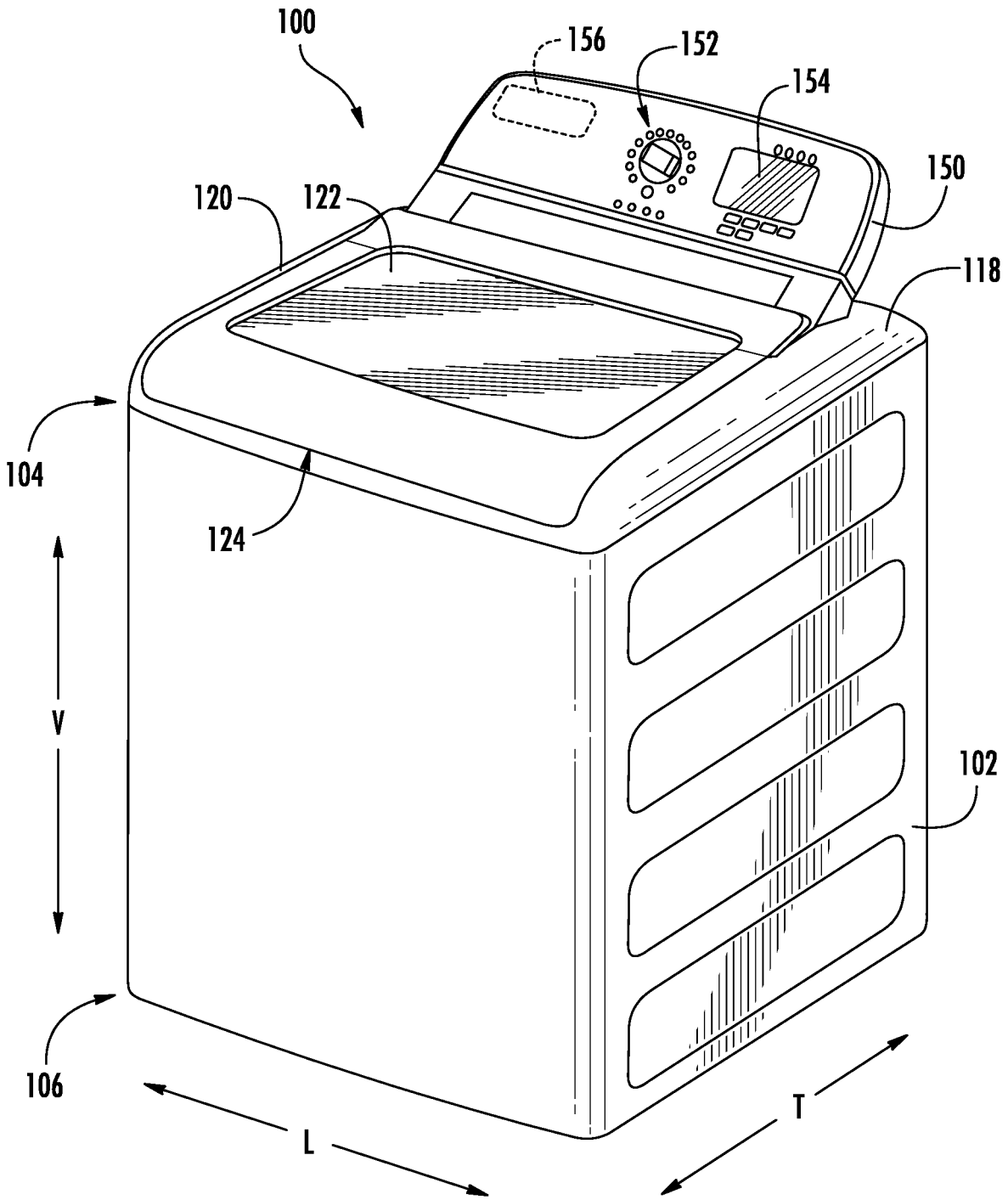
FIG. 1 provides a perspective view of a laundry appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
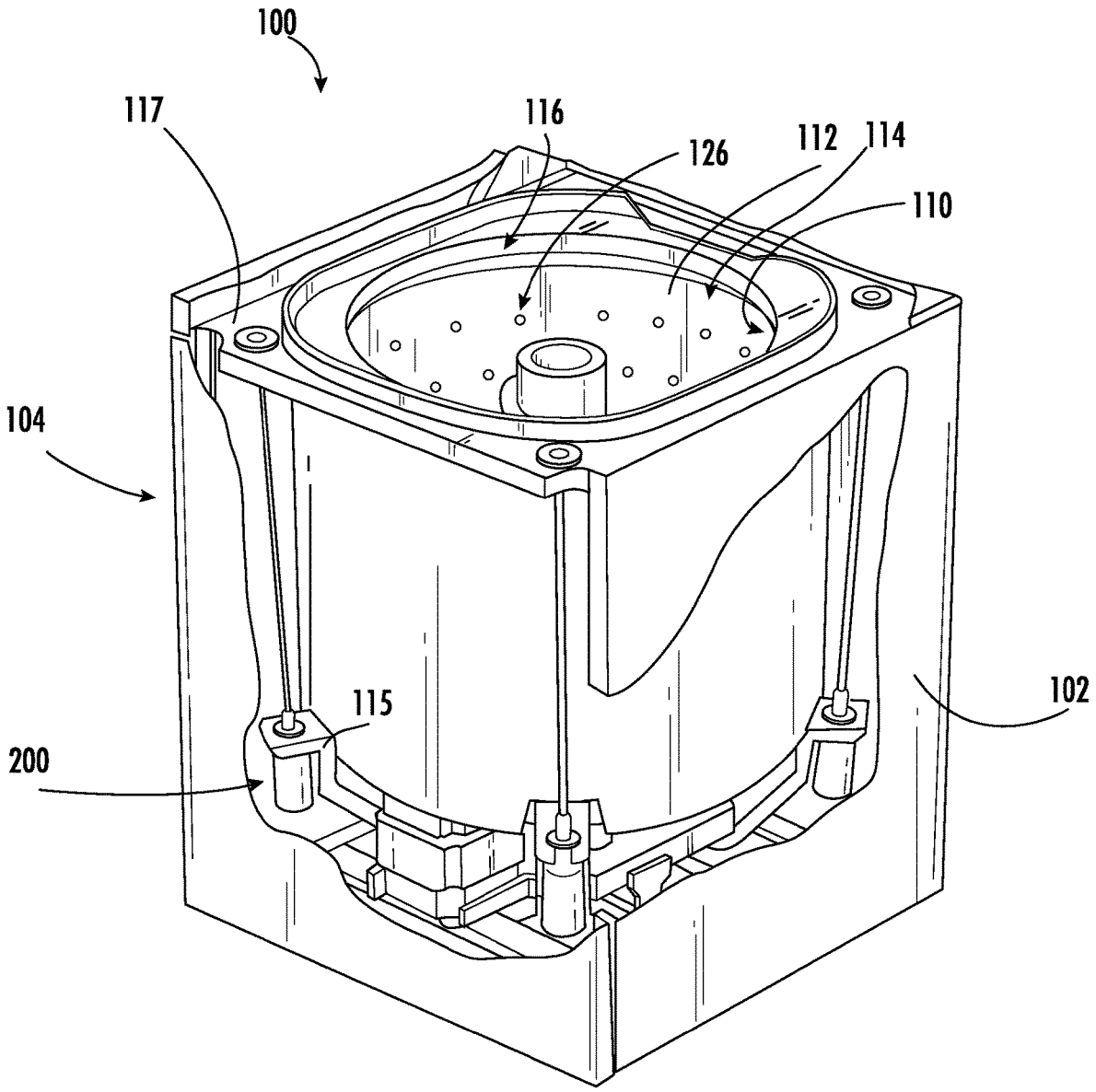
FIG. 2 provides a perspective view of the laundry appliance in accordance with one or more exemplary embodiments of the present disclosure.
Figure 3:
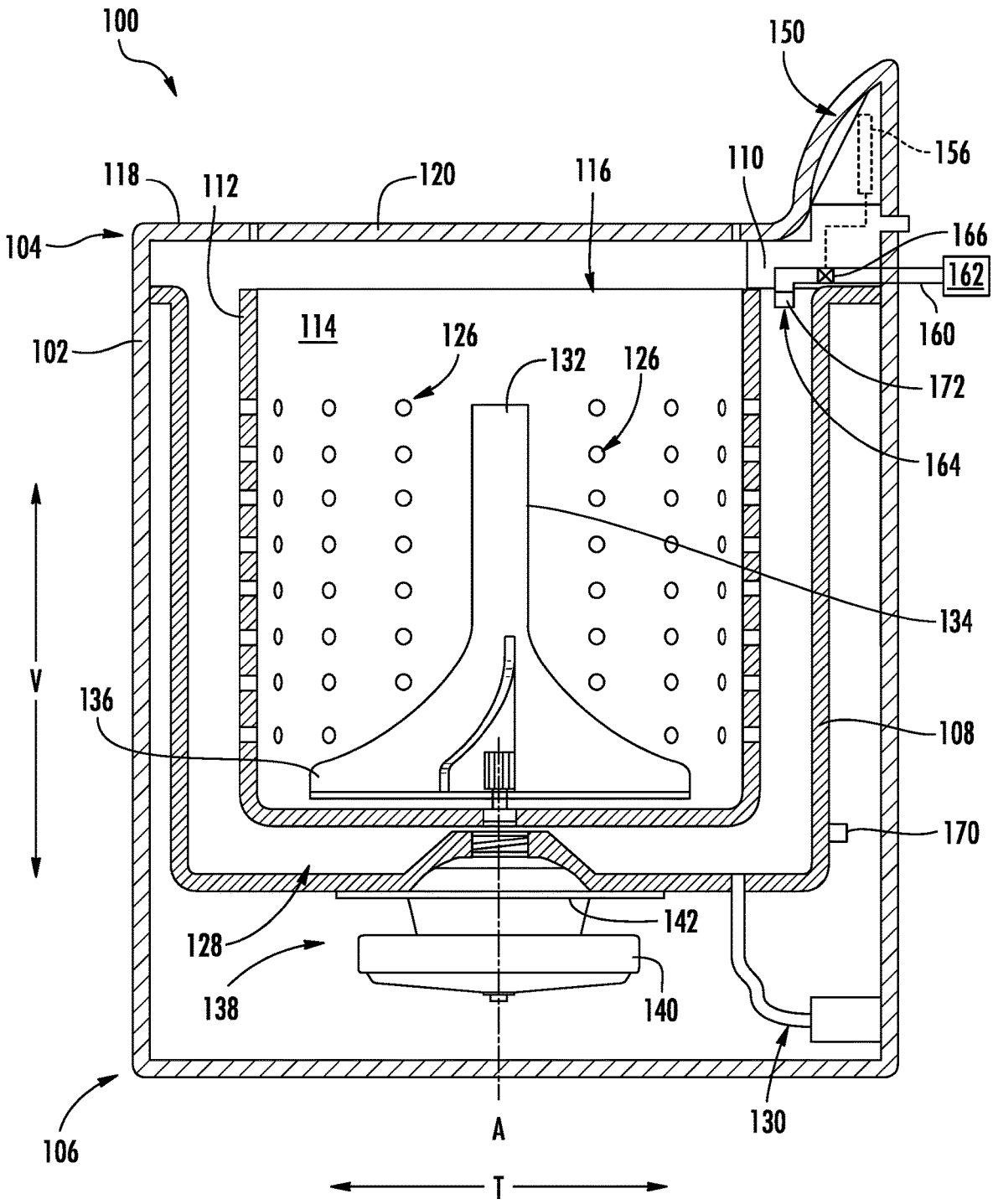
FIG. 3 provides a cross-section view of an exemplary laundry appliance in accordance with embodiments of the present disclosure.

FIGS. 1 through 3 illustrate an exemplary embodiment of a vertical axis laundry machine appliance or washing machine 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, laundry machine appliance 100 includes a drum or wash basket 112 that is positioned within tub 108 and generally defines a wash chamber 114 including an opening 116 for receipt of articles for washing. More specifically, wash basket 112 may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 defines an opening (FIG. 2) that coincides with opening 116 of wash basket 112 to permit a user access to wash basket 112. Laundry machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle.

An impeller or agitator 132 (FIG. 3), such as a vane agitator, impeller, auger, oscillatory basket mechanism, or some combination thereof is disposed in wash basket 112 to impart an oscillatory motion to articles and liquid in wash basket 112. More specifically, agitator 132 may include a shaft 134 extending along the vertical axis V and an oscillatory member 136 extending from the shaft 134. The agitator 132 may extend into wash basket and assists agitation of articles disposed within wash basket 112 during operation of laundry machine appliance 100, e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated.

As best illustrated in FIG. 3, laundry machine appliance 100 includes a drive assembly 138 in mechanical communication with wash basket 112 to selectively rotate wash basket 112 (e.g., during an agitation or a rinse cycle of laundry machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1-3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 is controlled by a controller or processing device 156 that is communicatively coupled with control panel 150 for user manipulation to select washing machine cycles and features. In response to user manipulation of control panel 150, controller 156 operates the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses.

Referring to FIG. 3, laundry machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. Laundry appliance 100 may include a flow meter 172. Flow meter 172 may be connected to water supply conduit 160 to measure an amount of water added to tub 108. Flow meter 172 may send the detected water flow amount to controller 156. In addition, laundry machine appliance 100 may include one or more pressure sensors 170 for detecting the amount of water and or clothes within tub 108. For example, pressure sensor 170 may be operably coupled to a side of tub 108 for detecting the weight of tub 108. Additionally or alternatively, pressure sensor 170 may detect and/or calculate a pressure of water within tub 108.

Referring now to FIGS. 4-10, embodiments of a damper assembly 200 are provided. The damper assembly 200 may be configured as an air damper. For instance, referring to FIG. 3, the damper assembly 200 may extend between the cabinet 102 and the tub 108, such as to form at least a portion of a suspension system positioning the tub 108 within the cabinet 102. For instance, referring to FIG. 2, the damper assembly 200 may extend from a base 115 at which the wash basket 112 is positioned and a top panel 117 at the cabinet 102. However, it should be appreciated that embodiments of the damper assembly 200 provided herein are not limited to attachment to the cabinet 102 and wash basket 112 as depicted and may be utilized in other suspension system and mounting configurations.

Figure 4:
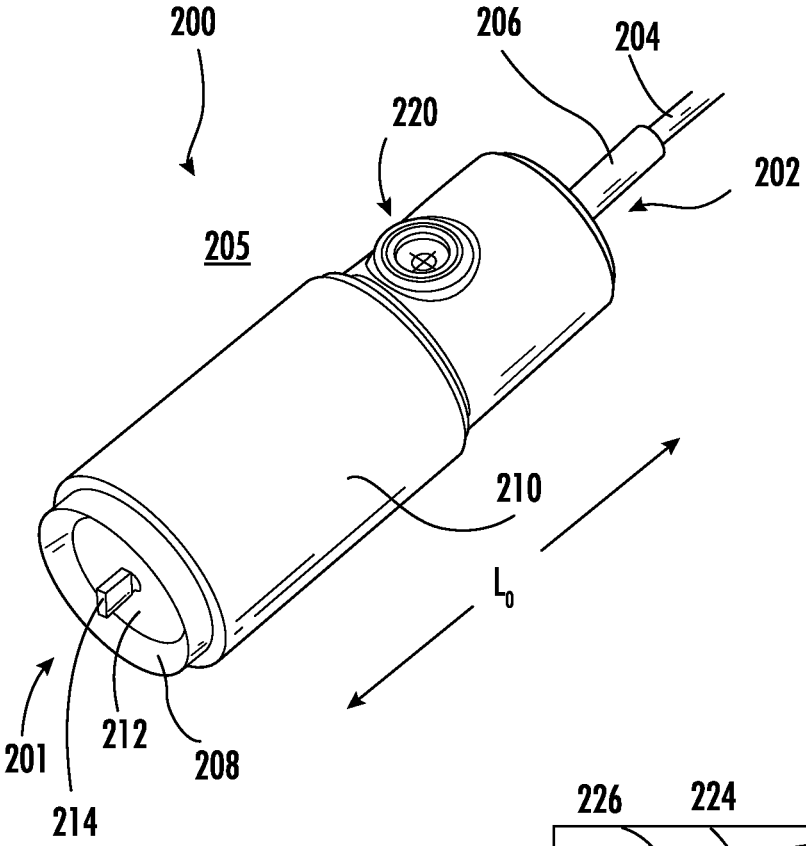
FIG. 4 provides a perspective view of an embodiment of a damper assembly for a laundry appliance in accordance with aspects of the present disclosure.
Figure 5:
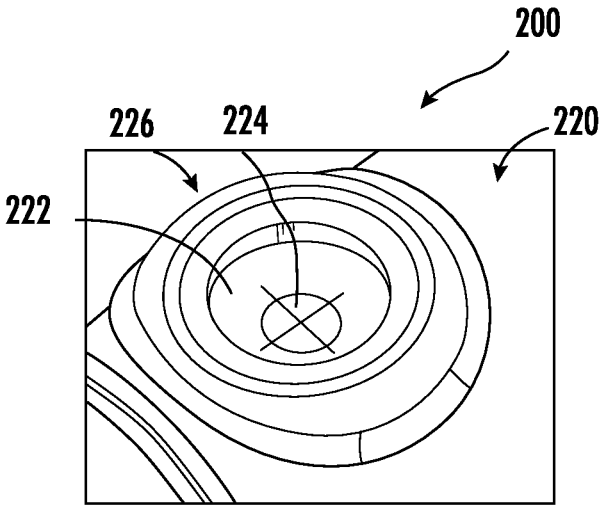
FIG. 5 provides a detailed perspective view of a valve of the damper assembly in accordance with aspects of the present disclosure.
Figure 6:
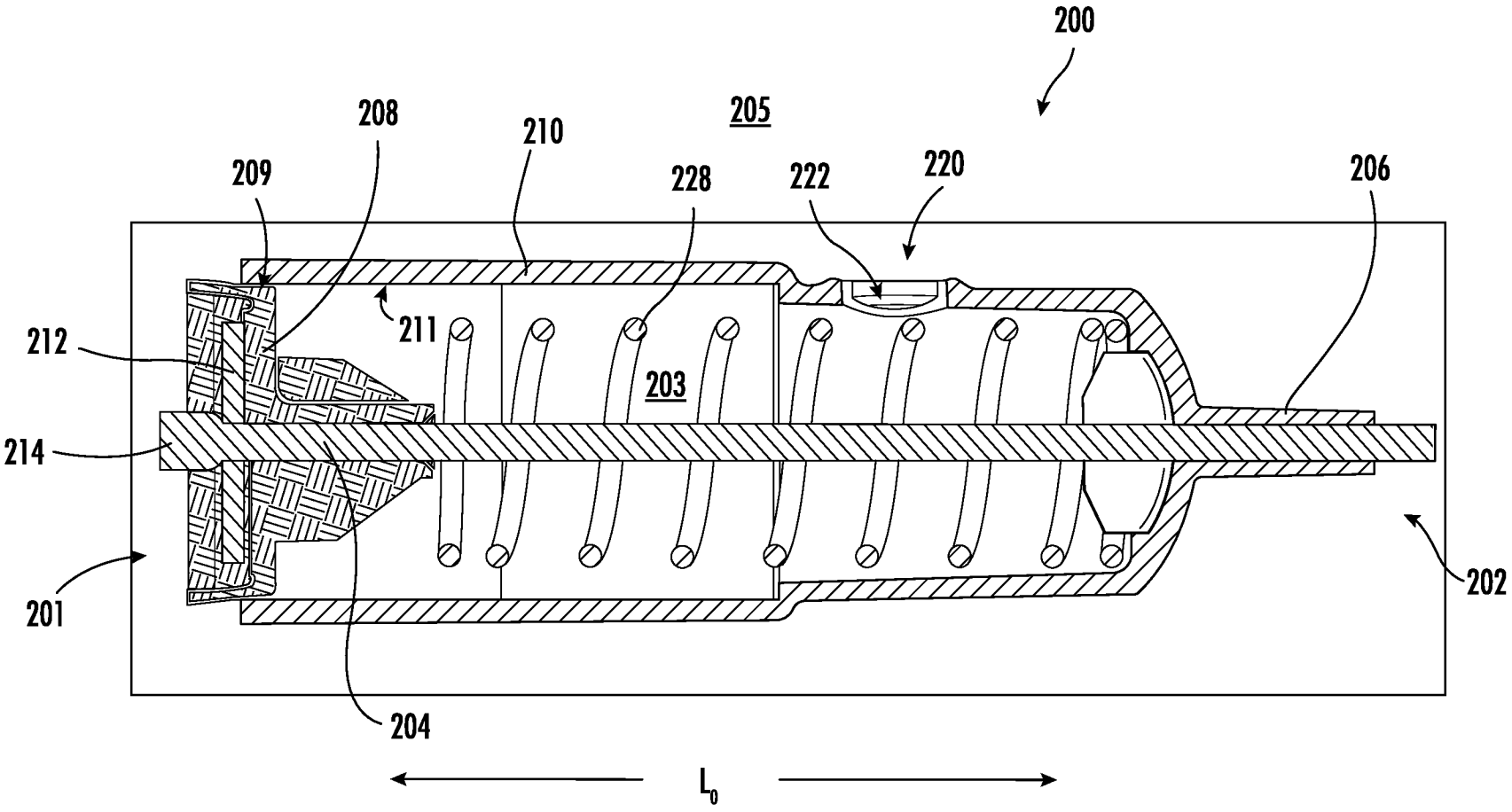
FIG. 6 provides an exemplary cross-section view of the damper assembly of FIG. 5 in accordance with aspects of the present disclosure.

FIG. 4 provides a perspective view of an embodiment of the damper assembly 200. FIG. 6 provides a cross-section view of an embodiment of the damper assembly 200. Referring to FIGS. 4-6, the damper assembly 200 includes a body 210, such as forming a cylinder or piston housing, extending between a first end 201 and a second end 202 separated along a longitudinal axis Lo. The damper assembly 200 includes a valve 220 providing fluid communication between an interior volume 203 (FIG. 6) formed within the body 210 and an exterior volume 205 (FIG. 4) outside of the body 210.

A longitudinally extended member 204, such as a shaft or rod, extends through the body 210 through the first end 201 and the second end 202. A plate 212, such as a washer, supports the member 204 within the body 210. For instance, the plate 212 is positioned at the first end 201. The member 204 extends through the interior volume 203 from the second end 202 through the plate 212 at the first end 201. The member 204 may include a head 214 forming a stop member or coupling member at the plate 212. A sleeve 206 may extend around the member 204 at the second end 202. The sleeve 206 may be slidably mounted to the member 204, such as to allow movement of the member 204 along the longitudinal axis Lo. The sleeve 206 may be integrally formed with body 210.

A piston 208 is mounted to the member 204 at the first end 201. The piston 208 extends radially from the member 204 to an inner surface 211 of the body 210. In various embodiments, piston 108 includes an outer surface 209 configured to contact, abut, or rub against the inner surface 211 of the body 210. Accordingly, the piston 208 is configured to generate a friction force against the inner surface 211 of the body 210. The plate 212 arranged with the piston 208 such that movement of the member 204 (e.g., along the longitudinal axis Lo) is able to translate into movement of the piston 208.

A spring 228 is positioned within the interior volume 203 of the body 210. The spring 228 is configured to generate a resistive force against the piston 208. For instance, the spring 228 may react against the piston 208 and plate 212 to adjust movement or feedback of the member 204 and form a damper. The spring 228 may further press against the second end 202 within the body 210.

FIG. 5 provides a detailed perspective view of an embodiment of the valve 220 positioned at the body 210. In various embodiments, such as depicted in FIGS. 4-9, the valve 220 may be positioned within an opening 226 at the body 210. One or more valves 220 may be positioned at the body 210 such as depicted in FIG. 4. In still some embodiments, additionally, or alternatively, the valve 220 may be positioned at the plate 212, piston 208, or both, and extending in fluid communication from the first end 201 into the interior volume 203, such as depicted in FIG. 10. Referring to FIG. 5, and further depicted in exemplary embodiments of movement of the valve 220 and spring 228 in FIGS. 6-9, the valve 220 includes a flexible wall 222, such as a diaphragm or membrane, configured to selectively allow a flow of air between the interior volume 203 and the exterior volume 205. In various embodiments, the flexible wall 222 includes a flap 224 selectively forming an opening 225 through which air may enter and egress the interior volume 203. Various embodiments of the flap 224 form a separable interface at the flexible wall 222, such as to configure the valve 220 as a self-sealing valve, such as a cross-slit valve, dispensing valve, air release valve, duckbill valve, or umbrella valve. The valve 220 is configured in a closed position (e.g., depicted in FIG. 7) and to open when a pre-determined pressure threshold is generated at the interior volume 203 (e.g., depicted in FIGS. 8-9). In various embodiments, the flexible wall 222 may be configured to open toward the inner volume 203, the exterior volume 205, or both.

Figure 7:
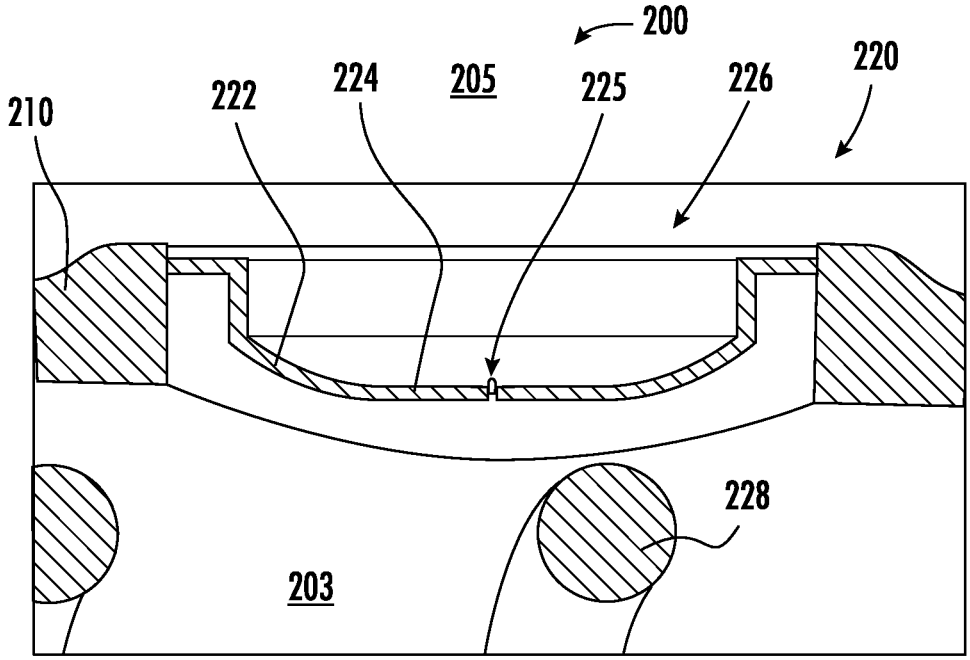
FIG. 7 provides an exemplary cross-section view of the valve of the damper assembly in a closed position in accordance with aspects of the present disclosure.
Figure 8:
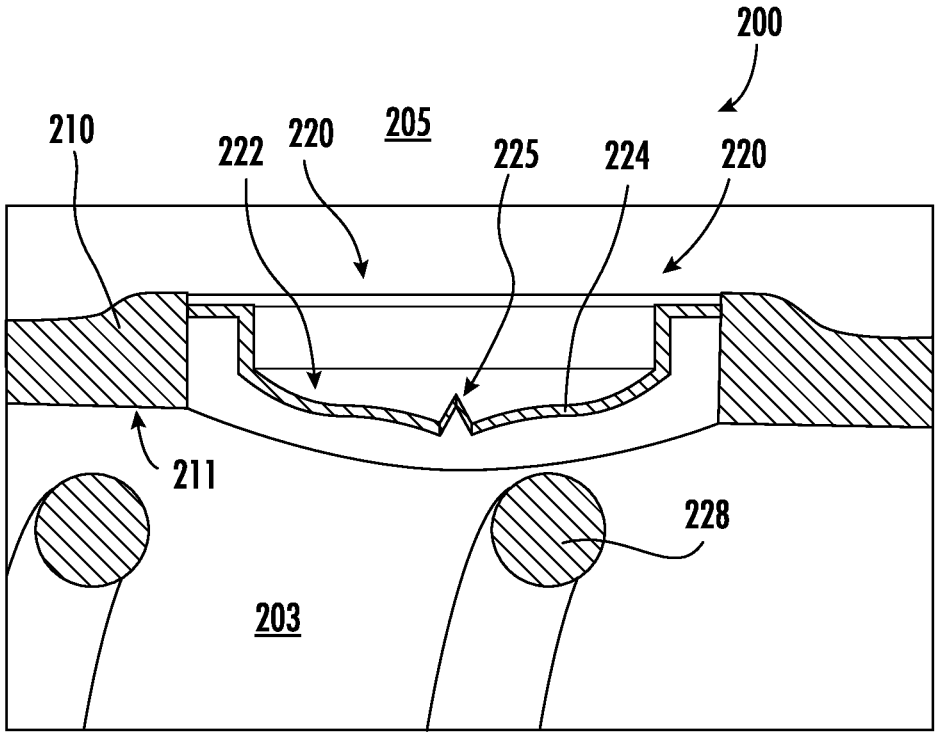
FIG. 8 provides an exemplary cross-section view of the valve of the damper assembly in a first open position during spring extension in accordance with aspects of the present disclosure.

In an embodiment of operation of the damper assembly 200, FIG. 7 depicts an exemplary cross-section view of the valve 220 in a closed position (i.e., the flap 224 at least partially closes the opening 225 to restrict or obstruct flow of air thereacross). FIG. 7 may depict the damper assembly 200, or furthermore, the appliance 100, in a substantially static position at which the member 204, piston 208, and spring 228 is substantially stationary along the longitudinal axis Lo. In an embodiment of operation of the damper assembly 200, FIG. 8 depicts an exemplary cross-section view of the valve 220 in a first open position during extension of the spring 228 (i.e., opening 225 is formed at flap 224 to allow a flow of air thereacross). In another embodiment of operation of the damper assembly 200, FIG. 9 depicts an exemplary cross-section view of the valve 220 in a second open position during compression of the spring 228.

During an exemplary embodiment of operation of the damper assembly 200, under relatively low speeds (e.g., a first speed threshold), as spring 228 is compressed, valve 220 remains closed, such as depicted in FIG. 7. The closed position may allow for maintaining a maximum damping force.

Figure 9:
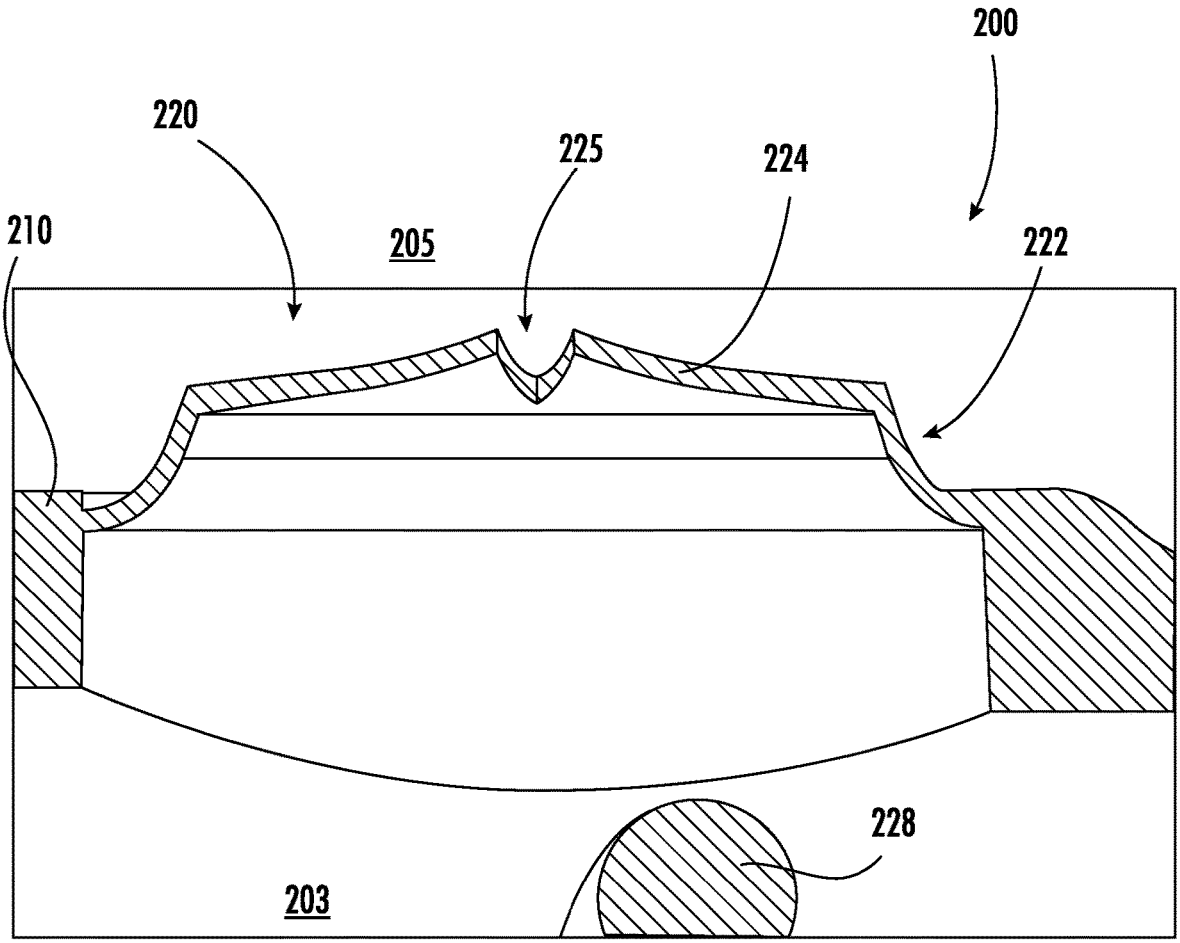
FIG. 9 provides an exemplary cross-section view of the valve of the damper assembly in a second open position during spring compression in accordance with aspects of the present disclosure.
Figure 10:
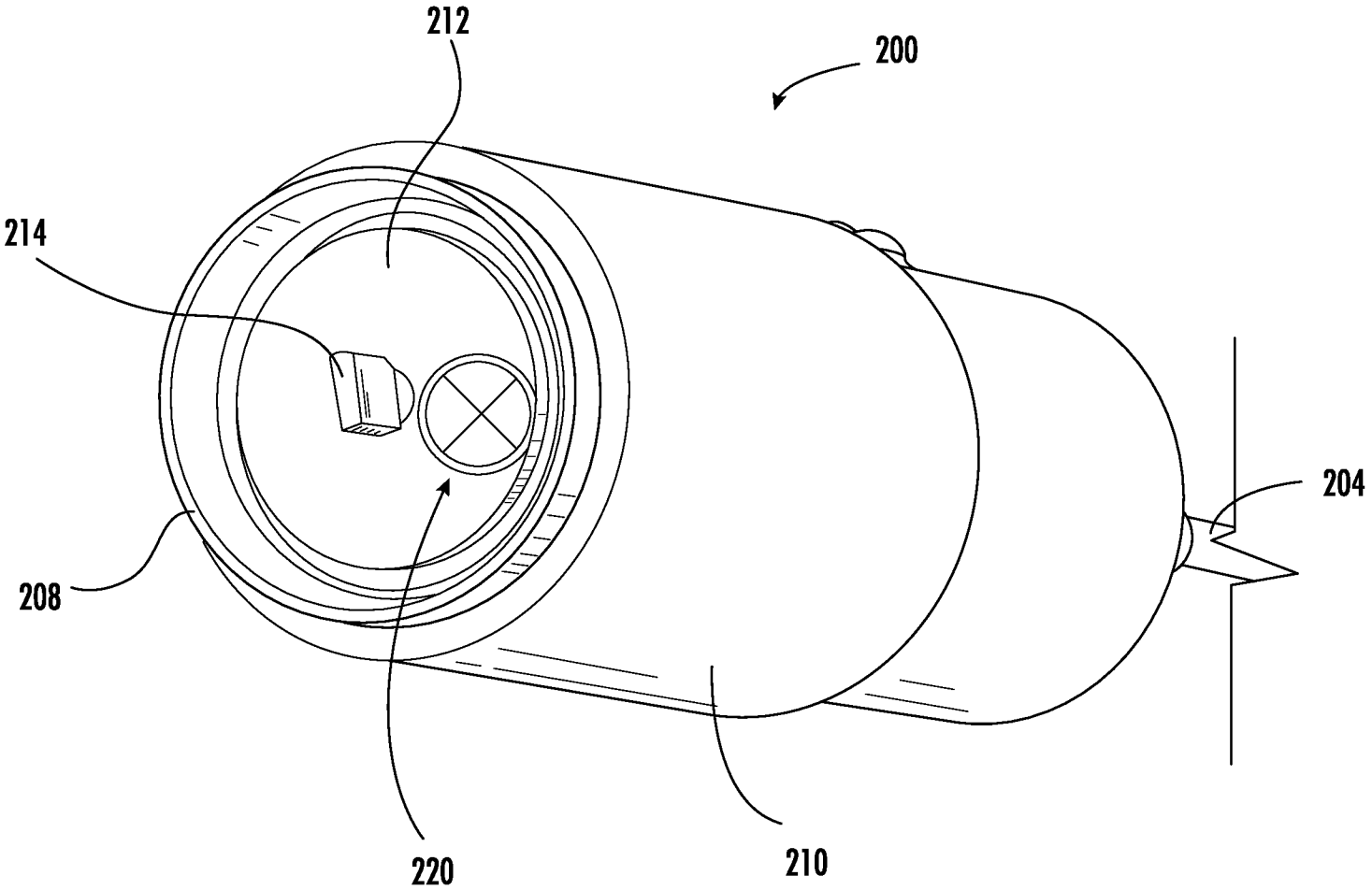
FIG. 10 provides a perspective view of an embodiment of a damper assembly for a laundry appliance in accordance with aspects of the present disclosure.

In some embodiments, such as depicted in FIG. 9, under relatively high speeds (e.g., above the first speed threshold), as spring 228 is compressed, pressure builds at interior volume 203. Valve 220 flexes and opens when a predetermined pressure threshold at the interior volume 203 is met or exceeded, such as to allow fluid communication between the exterior volume 205 and interior volume 203 and allow for reducing pressure at the interior volume 203. Accordingly, embodiments of the damper assembly 200 may avoid overdamping, such as overdamping corresponding to high compression damping or operation as a gas spring, and may reduce transmission of vibrations through the appliance 100 or to the ground at which the appliance 100 is positioned.

In still some embodiments, such as depicted in FIG. 8, valve 220 is configured to flex to allow air into the interior volume 203 as spring 228 is extending under any speed. Accordingly, embodiments of the damper assembly 200 may reduce a force required to return piston 208 to an extended position.

In still yet some embodiments, valve 220 may be configured to only allow air into the interior volume 203 through opening 225, such as to promote high compression damping at substantially all speeds, or furthermore, allow for reduced extension damping.

Various embodiments of the damper assembly 200 may include allowing various amounts of air leakage from between the outer surface 209 of the piston 208 and the inner surface 211 of the body 210, or between the member 204 and the sleeve 206, or between the member 204 and the piston 208.

Embodiments of the damper assembly 200 such as provided herein may prevent disconnection or misplacement of from the tub 108 during operation of the appliance 100, such as to maintain seating of the damper assembly 200 at the tub 108 (e.g., within a pocket, groove, or other interface at the tub 108). Preventing unseating may reduce undesired noise that may be associated with impact of the tub onto the damper assembly. Additionally, or alternatively, a reduced impact of the tub to the body of the damper assembly may increase reliability or decrease deterioration of the damper assembly 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance, comprising:

a cabinet defining an interior;

a tub mounted within the interior of the cabinet;

a laundry basket rotatably mounted within the tub, the laundry basket defining a chamber for the receipt of laundry articles; and a damper assembly coupling the cabinet to the tub, the damper assembly comprising a body forming an interior volume, a piston is coupled to a shaft extending through the interior volume, the piston extending to an inner surface of the body at the interior volume, wherein a spring is positioned within the interior volume and configured to generate a resistive force against the piston, the damper assembly comprising a valve comprising a flexible wall forming a separable interface configured to allow air to flow into the interior volume as the spring extend, wherein the flexible wall at the valve is configured to obstruct flow of air thereacross at or below a first speed threshold and when the spring is compressed, wherein the flexible wall at the valve is configured to form the opening during extension of the spring to allow fluid communication through the valve into the interior volume, and wherein the flexible wall at the valve is configured to form the opening during compression of the spring to allow fluid communication through the valve above the first speed threshold.

2. The laundry appliance of claim 1, wherein the flexible wall comprises a flap configured to selectively form an opening allowing air to flow into the interior volume of the body as the spring extends.

3. The laundry appliance of claim 1, wherein the valve is positioned at the body.

4. The laundry appliance of claim 1, wherein the valve is positioned at the piston.

5. The laundry appliance of claim 1, the shaft extending through the interior volume between a first end and a second end separated along a longitudinal axis, wherein the piston is positioned at the first end.

6. The laundry appliance of claim 5, wherein the body comprises a sleeve positioned at the second end, the shaft extending through the sleeve.

7. The laundry appliance of claim 6, wherein the sleeve is slidably mounted to the shaft to allow movement of the shaft along the longitudinal axis.

8. The laundry appliance of claim 1, the damper assembly comprising:

a plate supporting the shaft within the interior volume of the body, the plate configured to react against the piston.

9. A damper assembly for a laundry appliance, the damper assembly comprising:

a body forming an interior volume within the body and an exterior volume outside of the body;

a shaft extending through the interior volume;

a piston coupled to the shaft, the piston extending to an inner surface of the body at the interior volume;

a spring is positioned within the interior volume and configured to generate a resistive force against the piston; and a valve comprising a flexible wall forming a separable interface configured to allow air to flow into the interior volume as the spring extends wherein the flexible wall at the valve is configured to obstruct flow of air to the exterior volume at or below a first speed threshold and when the spring is compressed, and wherein the flexible wall at the valve is configured to form the opening to allow fluid communication through the valve to the exterior volume.

10. The damper assembly of claim 9, wherein the flexible wall comprises a flap configured to selectively form an opening allowing air to flow into the interior volume or the exterior volume as the spring extends.

11. The damper assembly of claim 9, wherein the valve is positioned at the body.

12. The damper assembly of claim 9, wherein the valve is positioned at the piston.

13. The damper assembly of claim 9, the shaft extending through the interior volume between a first end and a second end separated along a longitudinal axis, wherein the piston is positioned at the first end.

14. The damper assembly of claim 13, wherein a sleeve is positioned at the second end, the shaft extending through the sleeve.

15. The damper assembly of claim 14, wherein the sleeve is slidably mounted to the shaft to allow movement of the shaft along the longitudinal axis.

16. The damper assembly of claim 9, comprising:

a plate supporting the shaft within the interior volume of the body, the plate configured to react against the piston.

* * * * *